US010227792B2

(12) United States Patent
Choi

(10) Patent No.: US 10,227,792 B2
(45) Date of Patent: Mar. 12, 2019

(54) TENT HAVING ENHANCED TENT TOP

(71) Applicant: Campvalley (Xiamen) Co., Ltd., Xiamen (CN)

(72) Inventor: Kwanjun Choi, KyoungNam (KR)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 14/910,979

(22) PCT Filed: Dec. 19, 2013

(86) PCT No.: PCT/CN2013/089945
§ 371 (c)(1),
(2) Date: Jun. 28, 2016

(87) PCT Pub. No.: WO2014/180144
PCT Pub. Date: Nov. 13, 2014

(65) Prior Publication Data

US 2016/0290001 A1 Oct. 6, 2016

(30) Foreign Application Priority Data

May 8, 2013 (CN) ..... 2013 2 0244444 U

(51) Int. Cl.

| | |
|---|---|
| ***E04H 15/44*** | (2006.01) |
| ***E04H 15/46*** | (2006.01) |
| ***E04H 15/48*** | (2006.01) |
| *E04H 15/60* | (2006.01) |

(52) U.S. Cl.
CPC ..... *E04H 15/46* (2013.01); *E04H 15/44* (2013.01); *E04H 15/48* (2013.01); *E04H 15/60* (2013.01)

(58) Field of Classification Search
CPC ..... E04H 15/405; E04H 15/46; E04H 15/48
USPC ..... 403/164
See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 910,117 | A | 1/1909 | Crocker |
| 952,879 | A | 3/1910 | Crocker |
| 1,061,547 | A | 5/1913 | Kennedy |
| 1,129,194 | A | 2/1915 | Hanley |
| 1,347,107 | A | 7/1920 | McCann |

(Continued)

FOREIGN PATENT DOCUMENTS

| | | | |
|---|---|---|---|
| CA | 2 022 369 | A1 | 2/1991 |
| CN | 1076987 | A | 10/1993 |

(Continued)

*Primary Examiner* — David R Dunn
*Assistant Examiner* — Danielle Jackson
(74) *Attorney, Agent, or Firm* — Morgan, Lewis & Bockius LLP

(57) ABSTRACT

A tent with an enhanced tent top includes a top transverse rod, four upright rods, two tee connectors, and a cantilever rod. The top transverse rod has two ends. Each tee connector is pivotally connected to one end of the top transverse rod and two upright rods. The cantilever rod is movably or rotatably connected to the top transverse rod. The cantilever rod includes two free ends, which extend to two sides of the top transverse rod when the tent is unfolded.

9 Claims, 15 Drawing Sheets

(56) References Cited

U.S. PATENT DOCUMENTS 1,601,664 A * 9/1926 Ackerman ..... E04H 15/48 135/143
1,687,722 A 10/1928 Goldberg
2,113,118 A 4/1938 Pyatt
2,137,625 A 11/1938 Norvell
2,227,554 A 1/1941 Riordon
2,306,706 A 12/1942 Lucas
2,448,895 A 9/1948 Lawrence
2,530,765 A 11/1950 Greenup
2,555,220 A 5/1951 Brown
2,716,993 A 9/1955 Coderick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,454,021 A 7/1969 Morris
3,738,378 A 6/1973 Williams
3,766,932 A 10/1973 Sidis
3,810,482 A 5/1974 Beavers
3,929,146 A 12/1975 Maiken
4,003,181 A * 1/1977 Robinson ..... E04H 15/42 135/115
4,037,978 A * 7/1977 Connelly ..... F16B 7/04 403/164
4,066,089 A 1/1978 Rainwater
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,285,355 A * 8/1981 Lundblade ..... E04H 15/42 135/147
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,827,958 A 5/1989 Cantwell
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A 3/1991 Niksic et al.
5,230,358 A 7/1993 Forell
5,240,020 A 8/1993 Byers
5,255,698 A 10/1993 Riley
5,263,507 A 11/1993 Chuang
5,293,890 A 3/1994 Park et al.
5,328,286 A 7/1994 Lee
5,333,634 A 8/1994 Taylor
5,361,794 A 11/1994 Brady
5,421,355 A 6/1995 Cantwell
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A 6/1998 Shilna
5,771,654 A 6/1998 Moore et al.
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,230,728 B1 5/2001 Reese
6,283,136 B1 9/2001 Chen
6,286,530 B1 9/2001 Hussey
6,296,415 B1 10/2001 Johnson et al.
6,463,948 B2 10/2002 Lee
6,516,823 B1 2/2003 Gioveret et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,299,813 B2 11/2007 Ochi
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,628,165 B2 12/2009 Rothwell
7,656,024 B2 2/2010 Elbanhawy
7,686,024 B1 3/2010 Lai
7,810,514 B2 * 10/2010 Lah ..... E04H 15/60 135/120.1
7,861,736 B2 1/2011 Choi
7,891,367 B2 2/2011 Ma
8,033,289 B2 10/2011 Buckley
8,047,218 B1 11/2011 Shin
8,056,573 B2 11/2011 Panigot
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,590,554 B2 * 11/2013 Choi ..... E04H 15/48 135/120.2
D705,884 S 5/2014 Jin
8,763,621 B2 7/2014 Jin
8,889,814 B2 10/2014 Jin
8,910,648 B2 12/2014 Jin
8,919,364 B1 12/2014 Russell
9,051,034 B1 6/2015 Tarr
9,140,030 B2 * 9/2015 Jin ..... E04H 15/46
9,192,215 B2 11/2015 Ma
9,243,423 B2 * 1/2016 Jin ..... E04H 15/48
9,382,723 B2 7/2016 Choi
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffmann
2009/0173369 A1 * 7/2009 Lah ..... E04H 15/425 135/121
2012/0055525 A1 * 3/2012 Choi ..... E04H 15/48 135/147
2012/0318316 A1 12/2012 Choi et al.
2013/0014794 A1 1/2013 Jin
2013/0247948 A1 9/2013 Lovely et al.
2013/0318316 A1 11/2013 Yamada
2014/0076371 A1 * 3/2014 Jin ..... E04H 15/48 135/133
2014/0076372 A1 3/2014 Jin
2014/0109945 A1 4/2014 Jin
2014/0246062 A1 9/2014 Ma
2014/0261601 A1 9/2014 Jin
2014/0290710 A1 10/2014 Choi
2014/0311540 A1 * 10/2014 Choi ..... E04H 15/42 135/143
2015/0068573 A1 3/2015 Jin
2015/0083177 A1 3/2015 Hotes
2015/0167343 A1 6/2015 Fang
2015/0167344 A1 * 6/2015 Li ..... E04H 15/48 135/143
2015/0275541 A1 10/2015 Lamke
2015/0284974 A1 10/2015 Choi
2016/0060897 A1 3/2016 Baoqing

(56) References Cited

U.S. PATENT DOCUMENTS

| | | | | |
|---|---|---|---|---|
| 2016/0242567 | A1 | 8/2016 | Lime | |
| 2016/0281385 | A1* | 9/2016 | Choi | E04H 15/48 |
| 2016/0290003 | A1* | 10/2016 | Yang | E04H 15/34 |

FOREIGN PATENT DOCUMENTS

| | | | | |
|---|---|---|---|---|
| CN | 2401649 | Y | | 10/2000 |
| CN | 2506736 | Y | | 8/2002 |
| CN | 2635827 | Y | | 8/2004 |
| CN | 2697225 | Y | | 5/2005 |
| CN | 201013097 | Y | | 1/2008 |
| CN | 201103269 | Y | | 8/2008 |
| CN | 201129060 | Y | | 10/2008 |
| CN | 201202302 | Y | | 3/2009 |
| CN | 201695751 | U | | 1/2011 |
| CN | 102691439 | A | * | 9/2012 |
| CN | 2012204478761.4 | | | 9/2012 |
| CN | 202767622 | U | | 3/2013 |
| CN | 203034904 | U | | 7/2013 |
| CN | 103590650 | B | | 2/2014 |
| CN | 204163467 | U | | 2/2015 |
| FR | 1 121 851 | | | 8/1956 |
| FR | 68588 | | | 5/1958 |
| GB | 2 201 703 | A | | 9/1988 |
| GB | 2 259 927 | A | | 3/1993 |
| GB | 2535221 | A | | 8/2016 |
| KR | 10-2011-0054253 | A | | 5/2011 |
| WO | WO 2011/022764 | A1 | | 3/2011 |
| WO | WO 2013/116545 | A1 | | 8/2013 |
| WO | WO 2014/181953 | A1 | | 11/2014 |

* cited by examiner

TENT HAVING ENHANCED TENT TOP

CROSS-REFERENCE TO RELATED APPLICATIONS

This application is a U.S. National Phase of International Application No. PCT/CN2013/089945, filed Dec. 19, 2013, which claim priority to Chinese Application No. 201320244444.0, filed May 8, 2013, the disclosures of which are incorporated in their entireties.

TECHNICAL FIELD

The present invention relates to outdoor recreation products, in particular to a tent having an enhanced tent top.

BACKGROUND ART

As an outdoor product, tents become a necessity of people who like outdoor recreation activities such as travelling, camping and nature experience at present, and currently, the tents used for outdoor recreation have many types, including a large-size type and a small-size type, and also including a square type, a circular type and a hexagonal type. A tent mainly consists of tent cloth and a tent frame for supporting the tent cloth, a common tent support is generally formed by connecting a plurality of groups of support rods with a top rod, and the top rod forms top support. A well-known tent has the general defect that the structure is relatively complicated, for some tents, a pivoting base is arranged at the top to connect a plurality of tent top rods, so as to unfold and support the tent and increase a use area thereof, however, in this case, rod pieces of the tent are increased, a weight is larger, it is difficult and time-wasting to support and build the tent, and a manufacturing cost is also increased. For a top flat tent only adopting a transverse rod as the top rod, the top rod only achieves the supporting action on the top surface, a supporting area is only in one direction, a supporting surface cannot be formed by unfolding, a top area of the unfolded tent is limited and a use space of the tent cannot be further increased.

SUMMARY OF THE INVENTION

The present invention aims to provide a tent with an enhanced tent top, which can increase a top area of the tent, thereby increasing a use space of the tent.

For the objective, a solution of the present invention is as follows:

A tent with an enhanced tent top comprises a top transverse rod, wherein the two ends of the top transverse rod are respectively connected to a tee connector; each tee connector is respectively connected to two upright rods; the top transverse rod is movably connected to a cantilever rod; and the free ends of the cantilever rod extend to the sides of the top transverse rod.

The cantilever rod is a three-segment rod, with a middle rod piece thereof being connected to the middle of the top transverse rod, and the two ends of the middle rod piece being respectively connected to a side rod piece via a one-way connector.

The cantilever rod is rotatably connected to the top transverse rod.

The middle of the top transverse rod is provided with a connecting base, the middle of the cantilever rod is provided with a connector, and the connector is inserted into a positioning port arranged in the axial middle of the connecting base and rotatably moves in the positioning port.

A connector is arranged in the top transverse rod, two connecting sheets are arranged at two sides of the connector respectively, the cantilever rod is pivoted between the two connecting sheets of the connector, and the cantilever rod leans against the side of the top transverse rod in parallel after rotating for 90 degrees.

The top transverse rod comprises two top rods connected to a pivoting base; the pivoting base is provided with four pivoting notches therein; and the other two opposing pivoting notches are connected to two cantilever rods.

The top transverse rod is a fiber rod.

The cantilever rod is telescopic.

The top transverse rod is telescopic.

The top transverse rod comprises an outer sleeve positioned in the middle, the two sides of the outer sleeve are connected to an inner sleeve respectively, the end part of each inner sleeve is connected with a tee connector, and the tee connectors are connected with two groups of upright rods respectively.

The upright rod comprises an upper rod, a middle rod and a lower rod from top to bottom, the middle rod and the lower rod constitute a telescopic sleeve, the upper end of the middle rod is connected to the upper rod by an upwards folded one-way connector and the upper rod is connected into the tee connector.

The upper rod is a fiber rod.

The upright rod comprises the upper rod and the lower rod telescopically coupled to each other, and the upper rod is a fiber rod and connected into the tee connector at the end part of the top transverse rod.

After foregoing structure is adopted, according to the present invention, frame rods of a tent with an enhanced tent top are improved, wherein a cantilever rod is movably connected to a top transverse rod at the top surface of the tent, and the cantilever rod is connected to the top transverse rod and positioned at two sides thereof, thereby supporting tent cloth at the top surface of the tent in another direction; and a supporting surface is formed in the support rod piece at the top to support the top surface of the tent, thereby increasing a top area of the tent and further increasing a use space of the tent. Meanwhile, the cantilever rod of the present invention can be folded coordinating with folding of the tent cloth, the structure is simple and the use is convenient.

DETAILED DESCRIPTION

In order to further explain the technical solution of the present invention, the present invention is described in detail by specific embodiments.

A tent comprises tent frame rods as support and tent cloth connected thereto. The tent cloth can be directly connected to the tent frame rods, and coordinate with the unfolding and folding of the tent. The tent according to the present invention is a tent with an enhanced tent top, so as to simplify a top support structure of the tent. That is, the top of the tent is a rod piece as a support rod piece at the top of the tent, and standing rod pieces are connected to two sides of the top support rod piece, thereby forming a supporting tent frame for use. The present invention is specifically described by the following embodiments.

Figure 1:
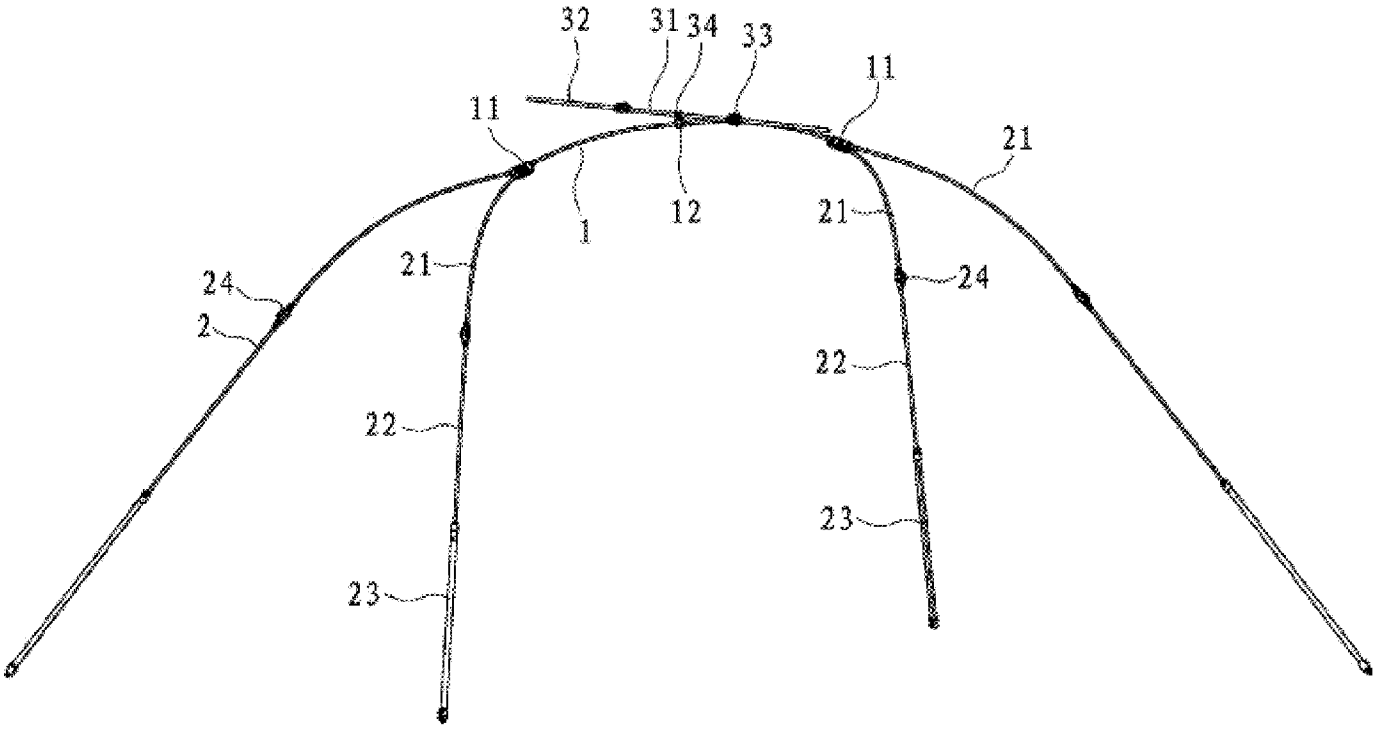
FIG. 1 is a schematic diagram illustrating a first embodiment of the present invention in an unfolded state.
Figure 2:
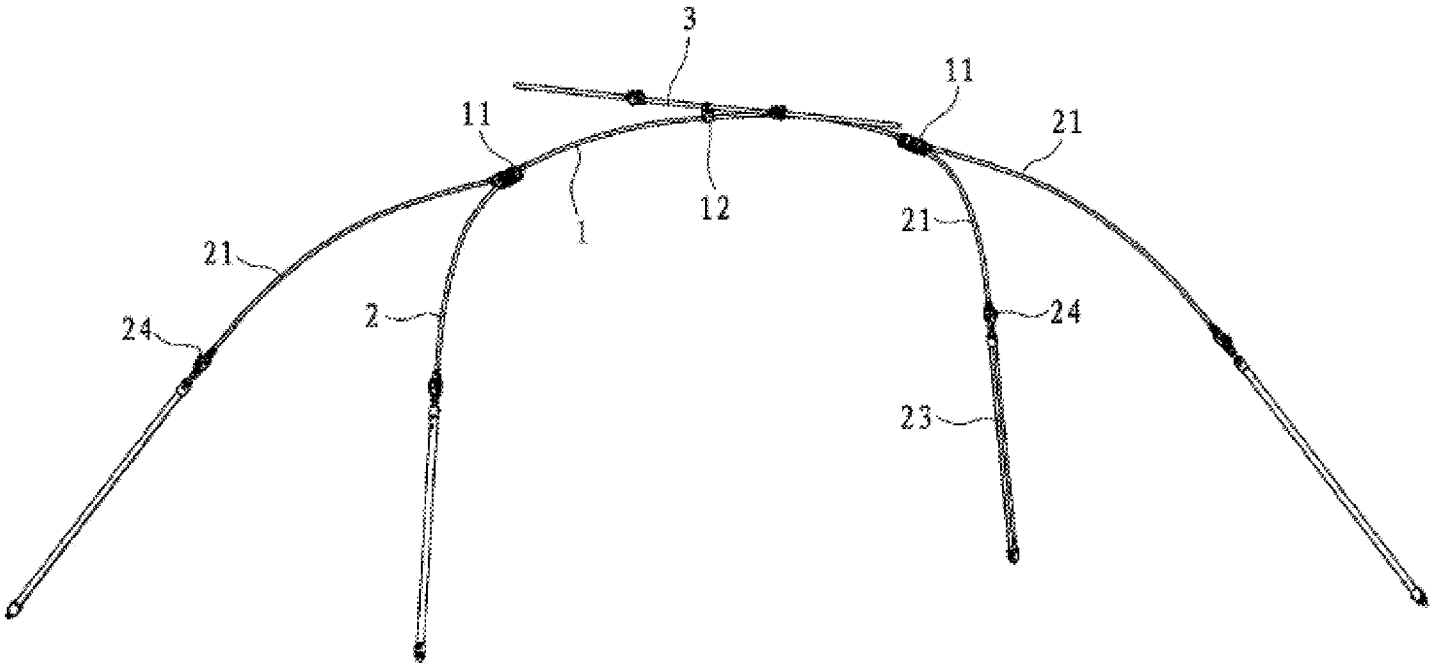
FIG. 2 is a schematic diagram illustrating the first embodiment of the present invention in a partially folded state.
Figure 3:
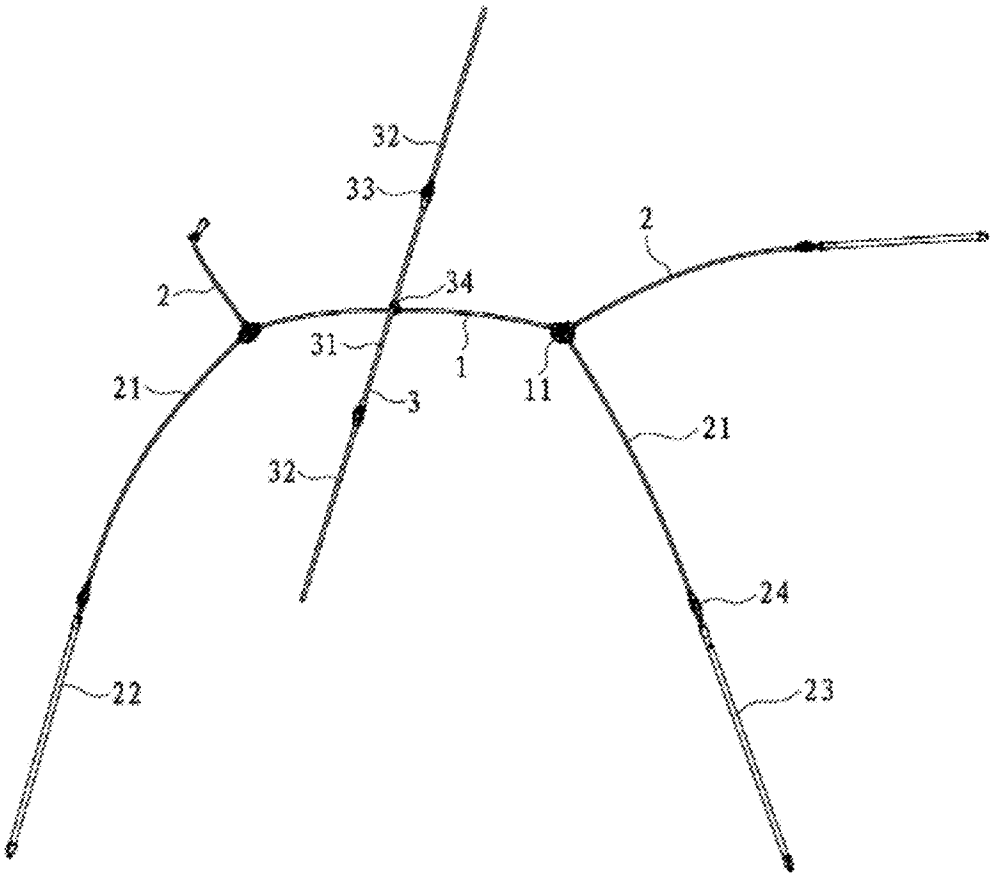
FIG. 3 is a schematic diagram illustrating the first embodiment of the present invention in another partially folded state.

FIG. 1 shows a first embodiment of the present invention. In the first embodiment, the tent with an enhanced tent top comprises a top transverse rod 1, wherein the two ends of the top transverse rod 1 are respectively connected to two upright rods 2 by a tee connector 11. The two upright rods 2 are respectively connected into two openings, or sockets, of the tee connectors 11. A certain opening angle exists between the two supporting upright rods 2, thereby forming butting support between the two upright rods 2 when unfolded. The two upright rods 2 can realize unfolding, folding and leaning through the tee connectors 11. To fold the tent, the two upright rods connected to the tee connectors 11 can be respectively folded upwards. Each upright rod 2 is telescopic so as to increase or adjust a height of the tent and facilitate folding. In the first embodiment, the upright rod 2 is a three-segment rod and comprises an upper rod 21, a middle rod 22 and a lower rod 23 from top to bottom. The upper rod 21 is connected with the tee connector 11. The middle rod 22 and the lower rod 23 are telescopically coupled to each other. The upper end of the middle rod 22 is connected to the upper rod 21 by a one-way connector 24. The middle rod 22 and the lower rod 23, for example when retracted, can be folded upwards to lean against the upper rod 21. According to the present invention, when the frame rods of the tent with an enhanced tent top are unfolded, the transverse top rod 1 is unfolded to form horizontal support, and the two upright rods 2 are unfolded to form stand support. An unfolded tent is formed with the stretched and unfolded tent cloth placed on the unfolded tent frame. The top transverse rod 1 and the upper rods 21 can be made of fiber rods, thereby forming an arch top surface when the tent is unfolded and thus producing a full and more attractive tent.

In order to unfold the tent frame rods to form a support surface and increase a top area of the tent so as to increase a use space of the tent, in the present invention, a cantilever rod 3 is further arranged on the top transverse rod 1 and is connected to the middle portion of the top transverse rod 1 in a crossing manner. The free ends of the cantilever rod 3 extend to the sides of the top transverse rod 1. The cantilever rod 3 extends to the sides of the top transverse rod so as to further support the top surface tent cloth when the tent is unfolded and in use. In the first embodiment, the cantilever rod 3 is a foldable rod with three segments. The cantilever rod 3 is connected to the top transverse rod 1. The cantilever rod 3 comprises a middle rod piece 31 connected to the middle portion of the top transverse rod 1. Each of the two ends of the middle rod piece 31 is connected to a side rod piece 32 by a one-way connector 33. To fold the tent, the side rod pieces 32 of the cantilever rod 3 positioned at two sides can be folded upwards through the one-way connectors 33.

Figure 4:
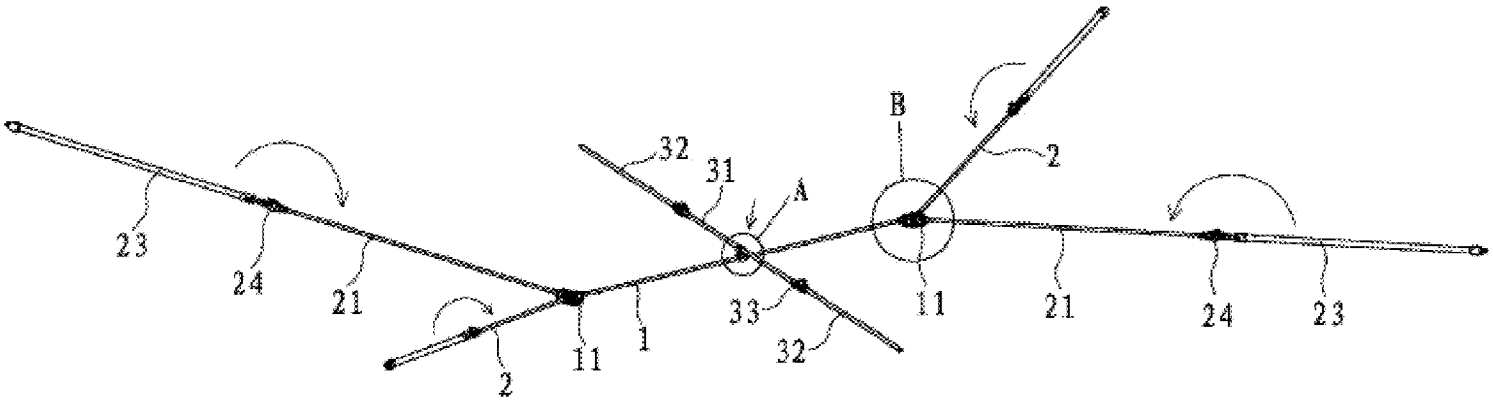
FIG. 4 is a schematic diagram illustrating further folding of the first embodiment of the present invention.
Figure 4A:
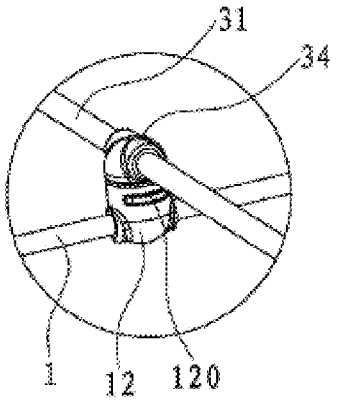
FIG. 4A is an enlarged view taken along circle A in FIG. 4.
Figure 4B:
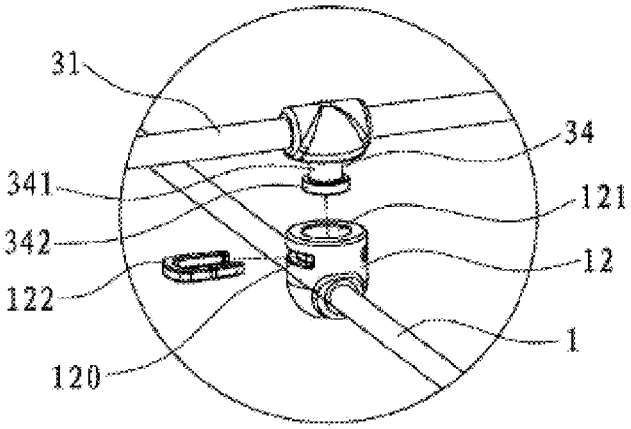
FIG. 4B is an exploded view of FIG. 4A.
Figure 4C:
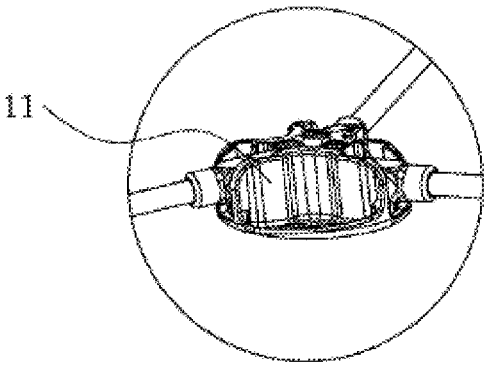
FIG. 4C is an enlarged view taken along circle B in FIG. 4.

The cantilever rod 3 is rotatably coupled with the top transverse rod 1. When the tent is unfolded, the cantilever rod 3 and the top transverse rod 1 are positioned crossing each other so that the cantilever rod 3 can assist in supporting the top surface tent cloth. To fold the tent, the cantilever rod 3 is rotated to align or in parallel with the top transverse rod 1. Referring to FIG. 4, the top transverse rod 1 is provided with a connecting base 12, and the middle portion of the cantilever rod 3 is provided with a connector 34 movably connected to the connecting base 12. The connector 34 is inserted into a positioning port 121 formed axially in the middle portion of the connecting base 12. The connecting base 12 is formed radially and symmetrically with two openings 120. A U-shaped clip 122 is inserted into the middle portion of the openings. The middle portion of the connector 34 forms a neck part 341. A snap ring 342 is formed below the neck part. The connector 34 is inserted into the positioning port 121. The U-shaped clip 122 passes through the neck part 341 of the connector and positioned in the connector. The snap ring 342 is larger than the opening of the U-shaped clip 122. The connector 34 can rotate in the positioning port 121. When rotating to the opening 120, the U-shaped clip 122 positions the connector 34, thereby movably connecting the connector 34 of the cantilever rod 3 with the connecting base 12 and facilitating rotation of the cantilever rod 3 such that it can be crossing or parallel with the top transverse rod 1.

Figure 5:
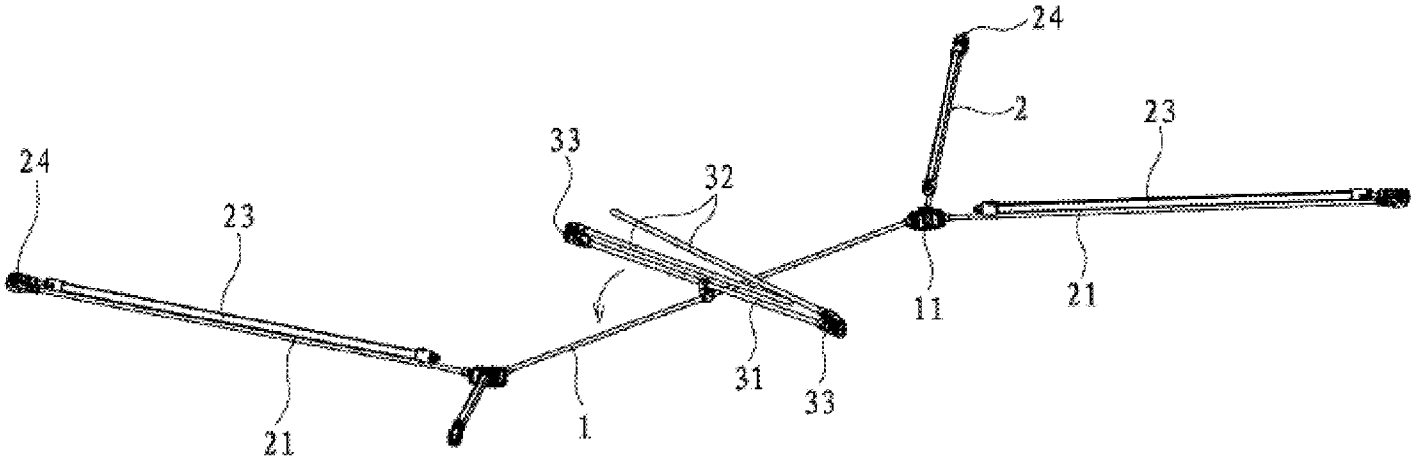
FIG. 5, FIG. 6 and FIG. 7 are schematic diagrams illustrating folding of the first embodiment of the present invention.
Figure 6:
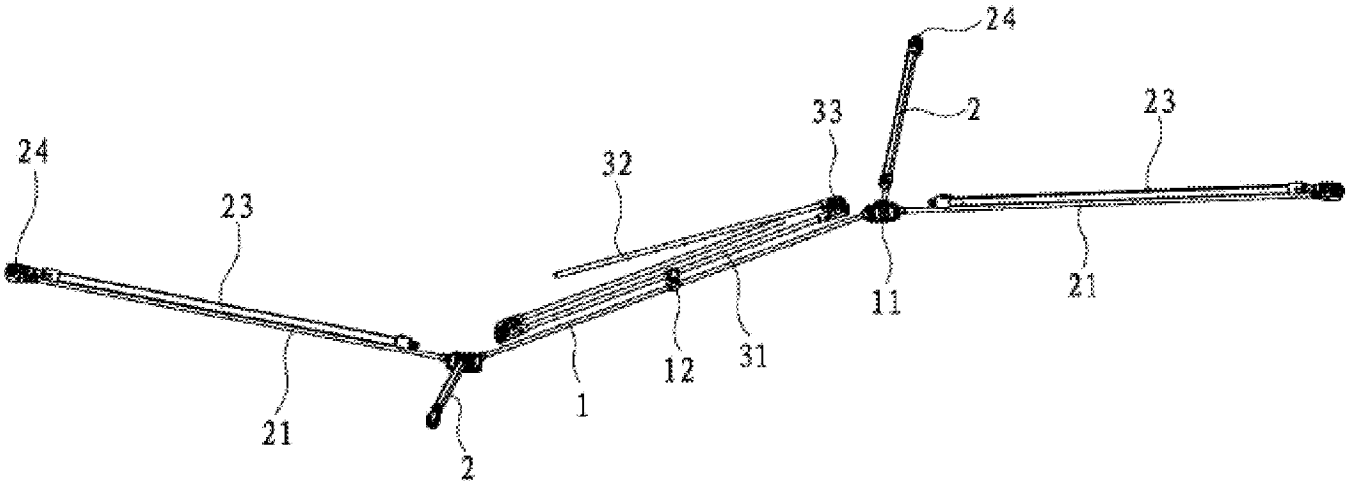
Figure 7:
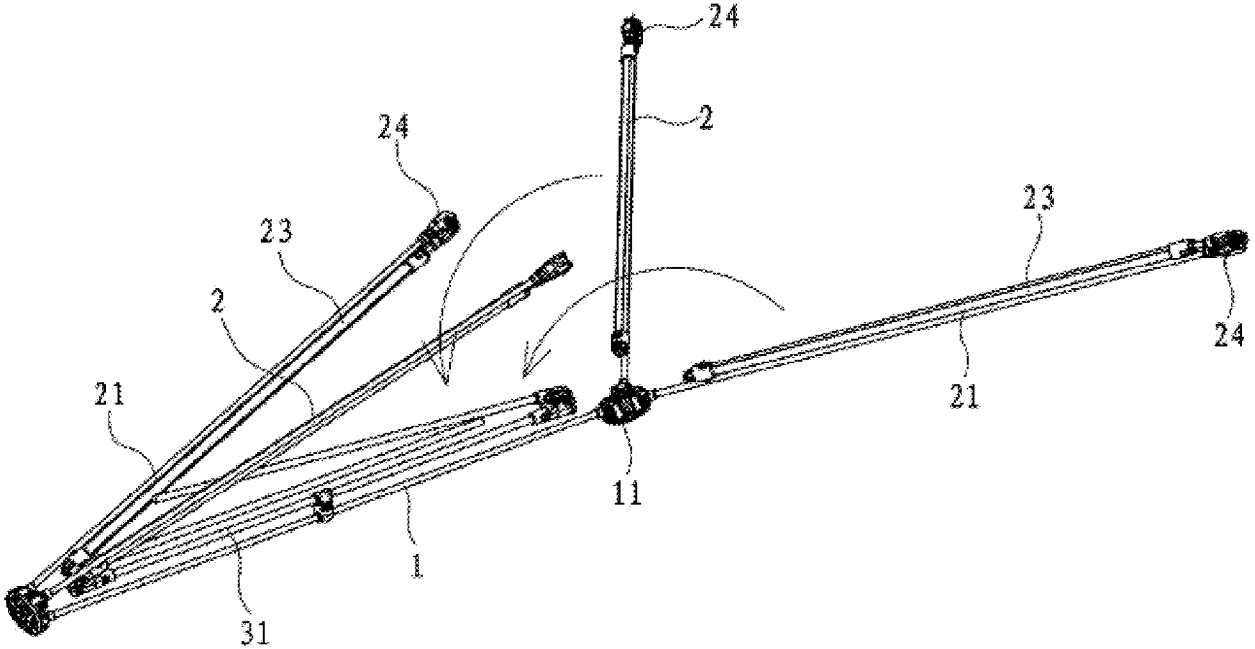

Referring to FIG. 2 to FIG. 7, to fold the tent, first, the upright rods 2 are folded. This can be achieved by contracting the middle rod 22 and lower rod 23, and folding the contracted middle rod 22 and lower rod 23 upwards through the one-way connector 24 towards the upper rod 21. At this point, the cantilever rod 3 is connected with the top transverse rod 1 in a crossing manner. First, the cantilever rod 3 is folded by folding the two side rod pieces 32 upwards respectively through the one-way connectors 33 towards the middle rod piece 31 as shown in FIG. 5, thereby reducing the length of the cantilever rod 3. Then through the connector 34, the folded cantilever rod 3 is rotated to be parallel with the top transverse rod 1, as shown in FIG. 6. Finally, as shown in FIG. 7, the easy-to-fold upright rods 2 respectively connected to the tee connectors 11 at the two ends of the top transverse rod 1 are folded upwards, and each group of upright rods 2 leans against the top transverse rod 1, thereby realizing integral folding of the tent frame rods and folding the tent to a minimal size.

Figure 8:
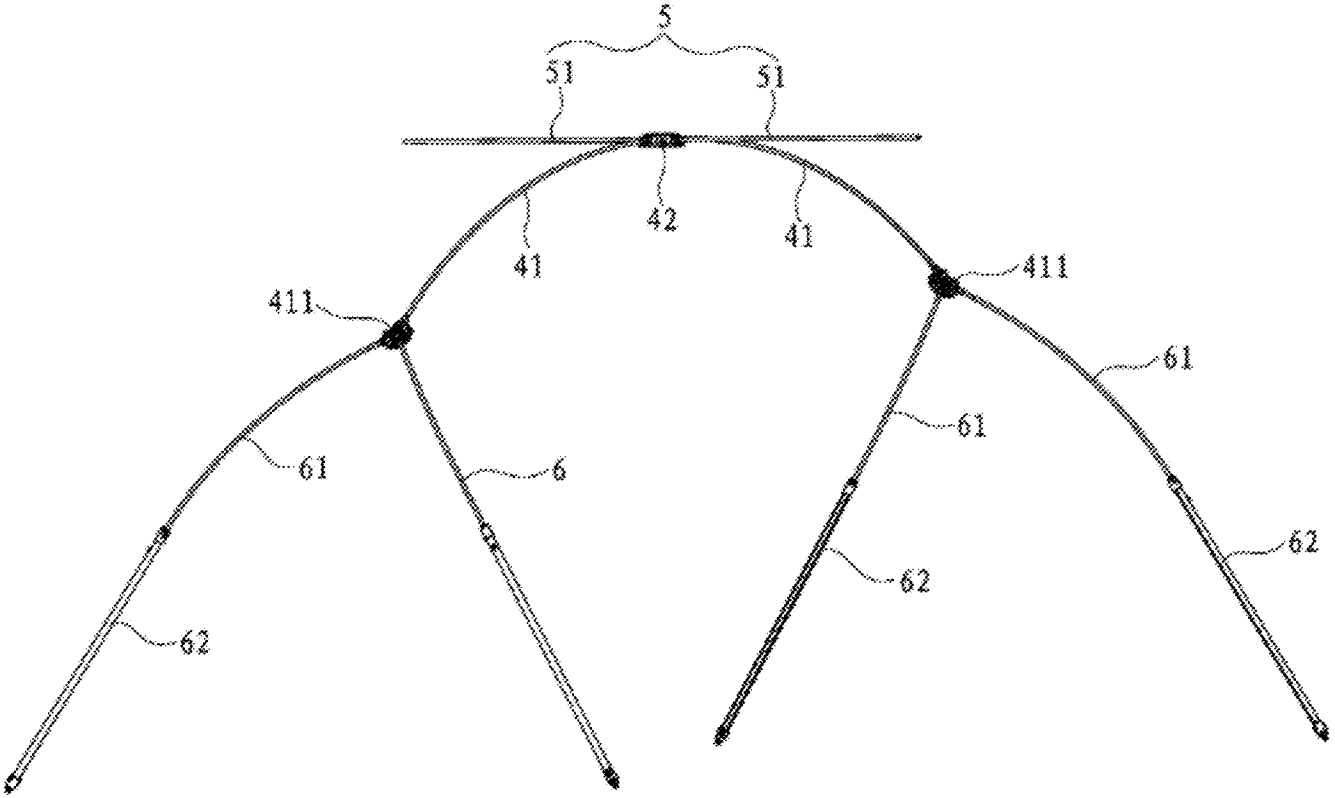
FIG. 8 is a schematic diagram illustrating a second embodiment of the present invention in an unfolded state.
Figure 9:
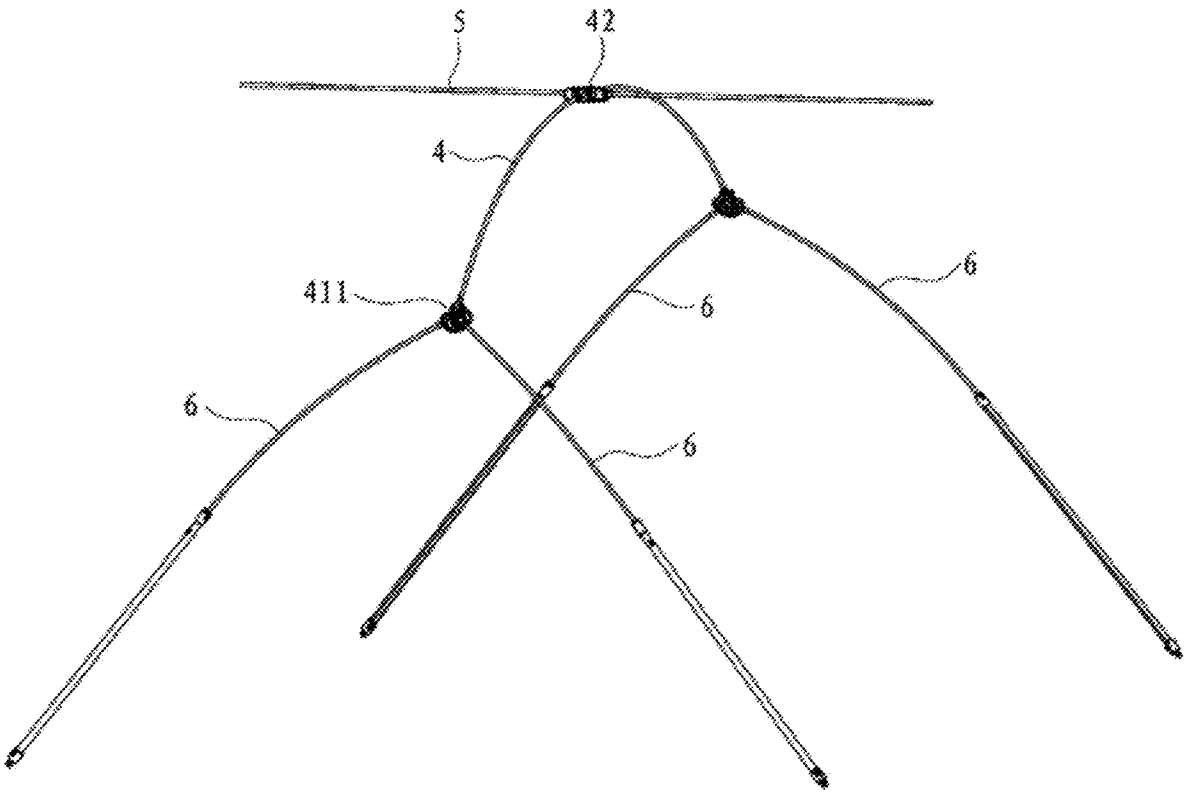
FIG. 9 is another schematic diagram illustrating a second embodiment of the present invention in an unfolded state.
Figure 10:
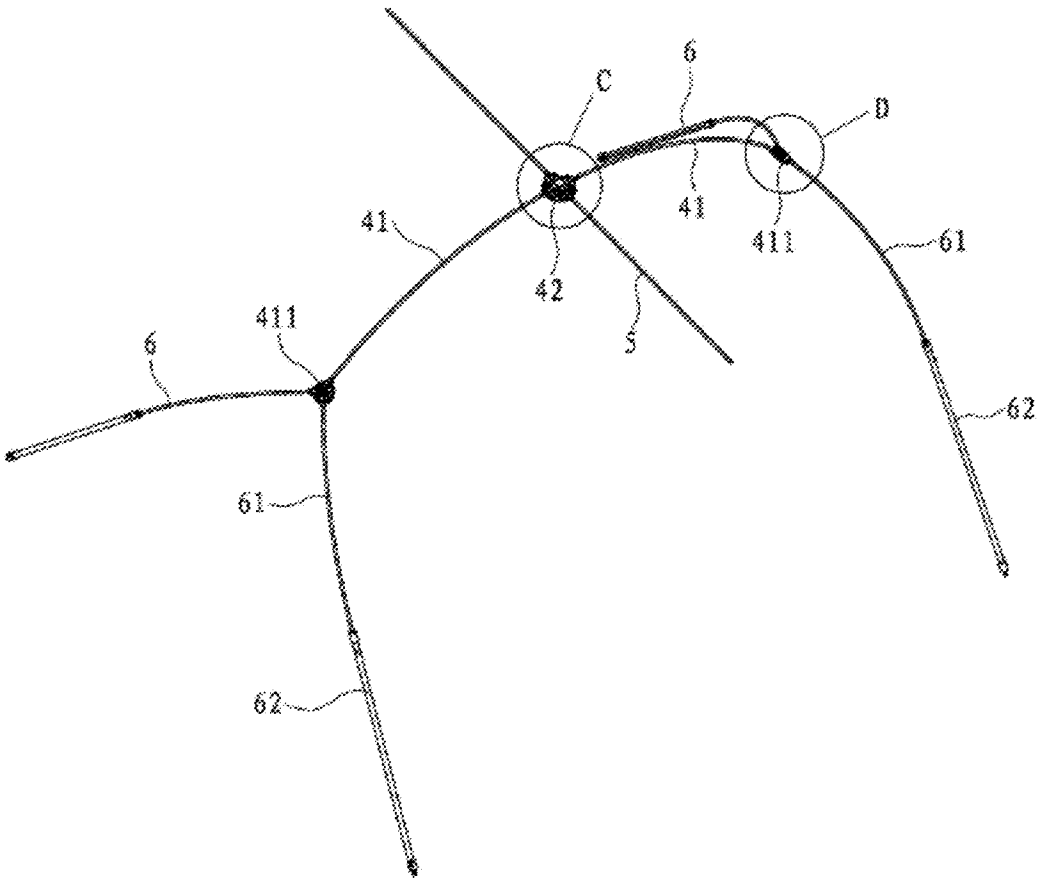
FIG. 10 is a schematic diagram illustrating the second embodiment of the present invention in a partially folded state.
Figure 10A:
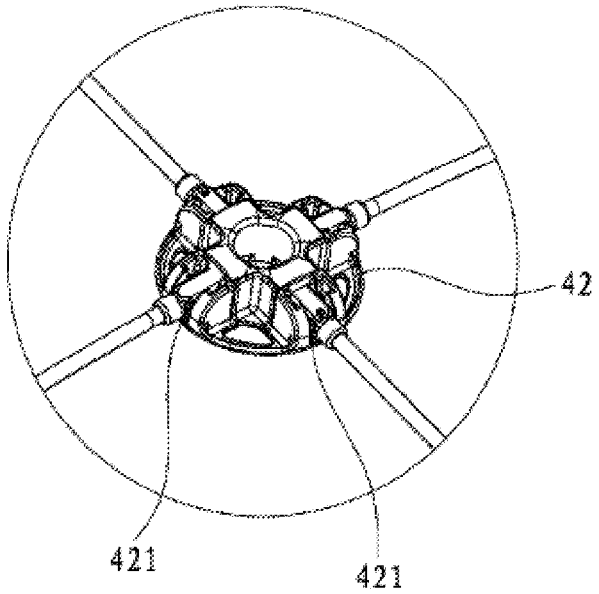
FIG. 10A is an enlarged view taken along circle C in FIG. 10.
Figure 10B:
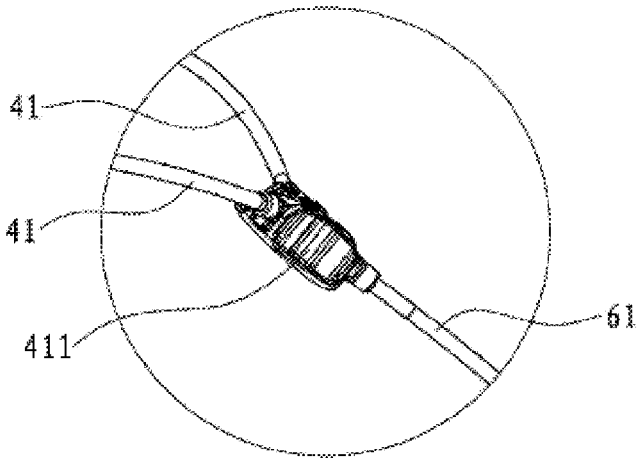
FIG. 10B is an enlarged view taken along circle D in FIG. 10.

FIG. 8 - FIG. 10 show a second embodiment of the present invention. In the second embodiment, the top transverse rod 4 is a fiber rod with tenacity and comprises two top rods 41 connected to each other through a pivoting base 42. The two top rods 41 are also fiber rods, thereby producing an arch and more attractive tent top surface when the tent is unfolded. The pivoting base 42 is provided with four pivoting notches 421 therein. Two pivoting notches 421 are pivoted with two opposite top rods 41, the other two opposite pivoting notches 421 are connected with two cantilever rods 51. The two cantilever rods 51 comprise the singular cantilever rod 5. The two top rods 41 and the two cantilever rods 51 are pivoted in the pivoting notches and can be folded upwards. One tee connector 411 is connected to outer end parts of the two top rods 41 respectively. The tee connector 411 is provided with two openings therein which are connected with two upright rods respectively. The upright rods 6 are connected into the tee connector 411 respectively. A certain opening angle exists between the two supporting upright rods 6, thereby forming butting support between the two upright rods 6. The two upright rods 6 can realize unfolding, folding and leaning through the tee connector 411. Each upright rod 6 is telescopic and comprises an upper rod 61 and a lower rod 62. The upper rod can be sleeved into the lower rod 62, and the two can be extended. The upper rod 61 is connected with the tee connector 411, and the upper rod 61 is a fiber rod with tenacity, thereby producing a full and more attractive tent.

To fold the tent with an enhanced tent top in accordance with the second embodiment, after the upright rods 6 are contracted, only the folded upright rods 6 need to be folded upwards to lean against the top rods 41. Meanwhile, the cantilever rods 51 can also be folded upwards. Finally, the cantilever rods 51, the leaned top rods 41 and the upright rods 6 are folded below the pivoting base 42 to realize the integral folding of the frame rods.

Figure 11:
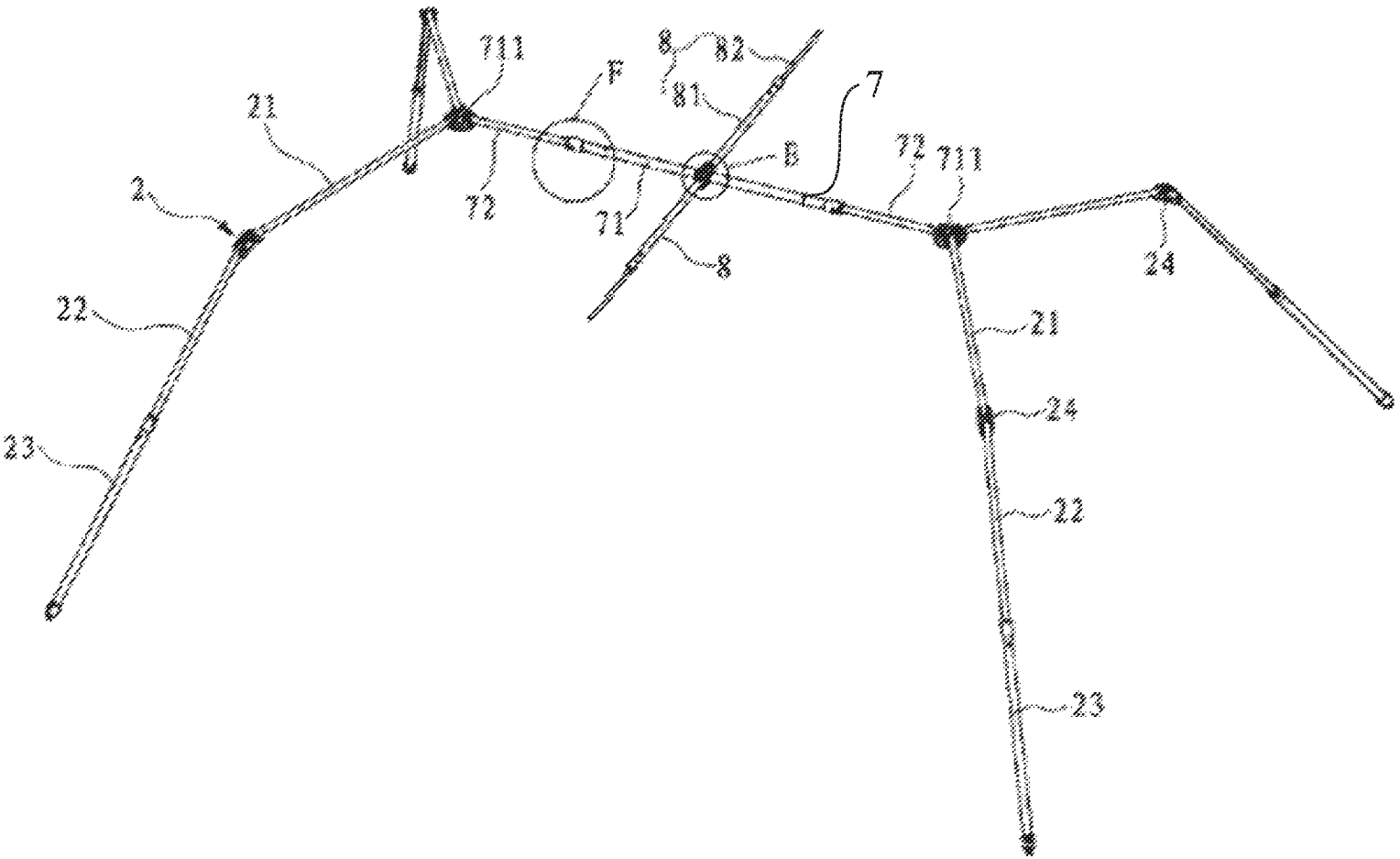
FIG. 11 is a schematic diagram illustrating a third embodiment of the present invention in an unfolded state.
Figure 11A:
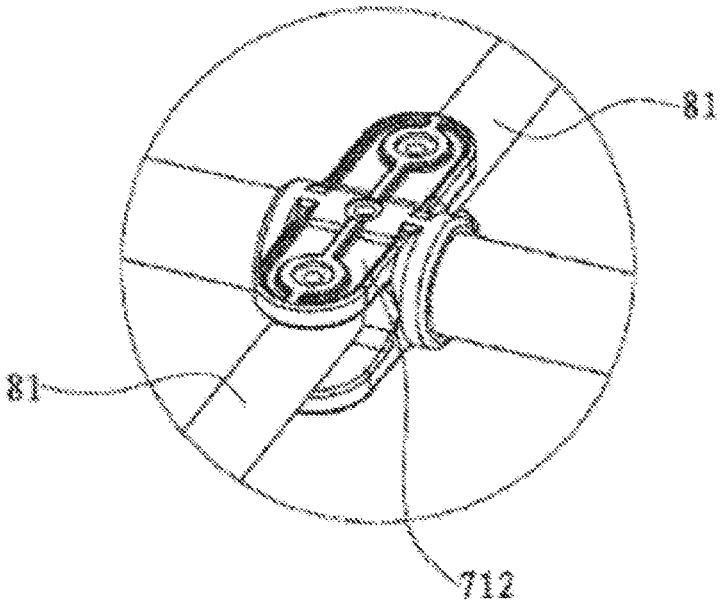
FIG. 11A is an enlarged view taken along E in FIG. 11.
Figure 11B:
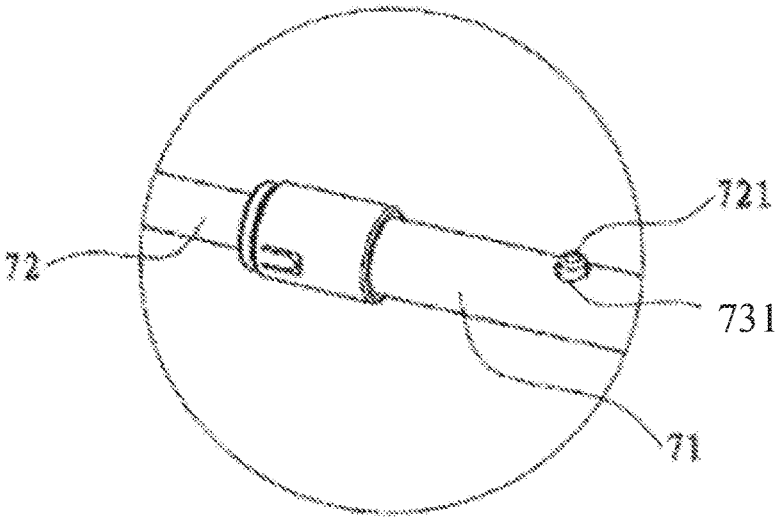
FIG. 11B is an enlarged view taken along F in FIG. 11.

FIG. 11 shows a third embodiment of the present invention, which differs from the first embodiment. The top transverse rod 7 in the third embodiment is telescopic, and comprises an outer sleeve 71 positioned in the middle and inner sleeves 72 connected to the two sides of the outer sleeve 71 respectively. A positioning hole 731 is arranged in the outer sleeve 71, and the inner sleeves 72 are provided with elastic bulges 721. The inner sleeves 72 are telescopically coupled with the outer sleeve 71. A tee connector 711 is connected to the end part of each inner sleeve 72. Each tee connector 711 is connected with two groups of upright rods 2 respectively. Each upright rod 2 is telescopic to increase or adjust a height of the tent and facilitate folding. The upright rod 2 comprises an upper rod 21, a middle rod 22 and a lower rod 23 from top to bottom. The middle rod 22 and the lower rod 23 are telescopically coupled to each other. The upper end of the middle rod 22 is connected to the upper rod 21 by a one-way connector 24. The middle rod 22 and the lower rod 23, for example when retracted, can be folded upwards to lean against the upper rod 21. On the top transverse rod 7, a connector 712 is arranged in the middle portion of the outer sleeve 71. A cantilever rod 8 is arranged respectively at two sides of the connector 712. The two sides of the connector 712 are respectively provided with two connecting sheets for connecting cantilever rods 8. The cantilever rods 8 are pivoted between the two connecting sheets of the connector 712 and can rotate 90 degrees, thereby allowing the cantilever rods 8 to be folded and lean against the top transverse rod 7 in parallel. The two opposite cantilever rods 8 when unfolded crisscross with the top transverse rod 7, thereby assisting in supporting of the top surface tent cloth when the tent is unfolded. In an embodiment, each cantilever rod 8 is also telescopic, and comprises an outer sleeve 81 connected to the top transverse rod 7 and an inner sleeve 82. As such, the length of the cantilever rods 8 can be adjusted, facilitating folding and unfolding of the tent.

To fold the tent with an enhanced tent top in accordance with the third embodiment, after each upright rod 2 is contracted, only each folded upright rod 2 needs to be folded upwards to lean against the top transverse rod 7. The cantilever rods 8 are contracted and then lean against the side of the top transverse rod 7 in parallel. Finally, the contracted top transverse rod 7 and the upright rods 2 lean together to realize the folding of the frame rods.

Figure 12:
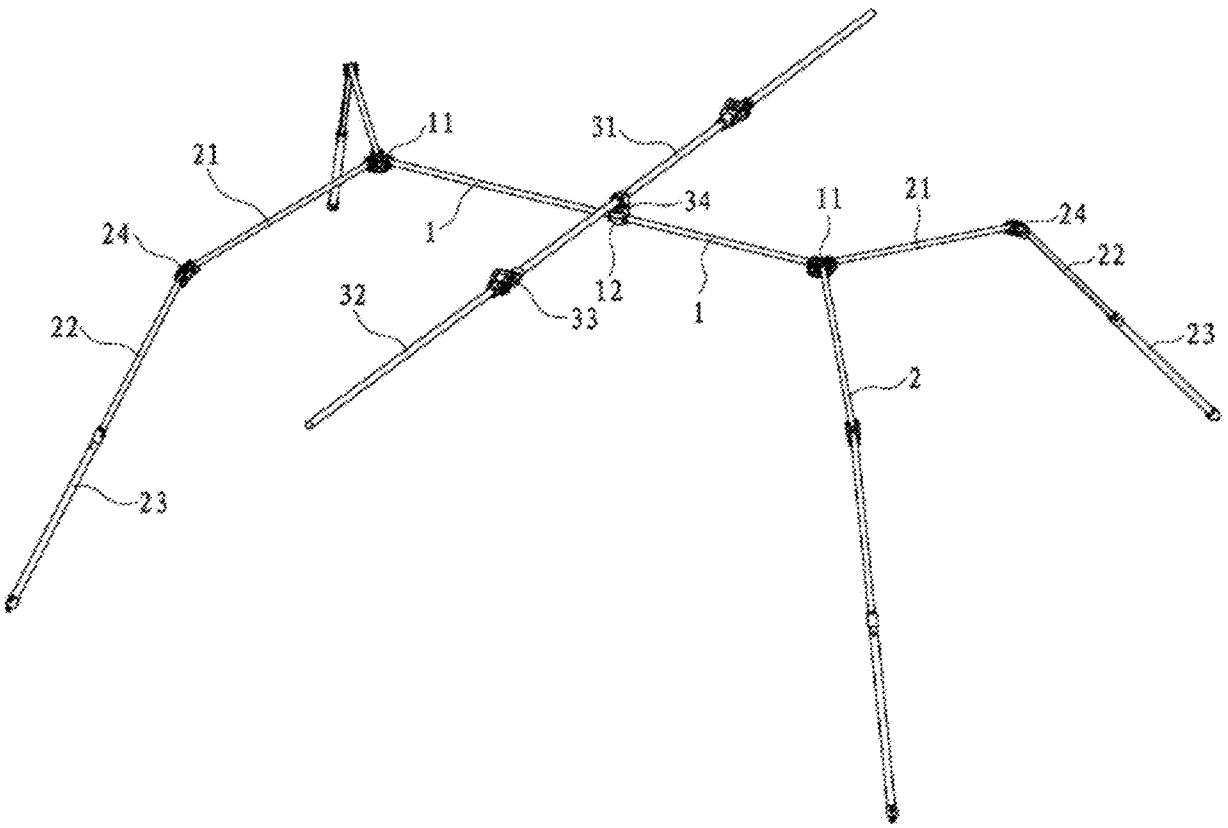
FIG. 12 is a schematic diagram illustrating a fourth embodiment of the present invention in an unfolded state.

FIG. 12 shows a fourth embodiment of the present invention. The fourth embodiment is similar to the first embodiment. In the fourth embodiment, each rod piece is an iron tube instead of fiber rod, and the integral unfolding and folding of the tent is relatively smoother. As shown in the figure, the tent with an enhanced tent top comprises a top transverse rod 1. The two ends of the top transverse rod 1 are respectively connected to two upright rods 2 by a tee connector 11. Each upright rod 2 is telescopic so as to increase or adjust a height of the tent and facilitate folding. The upright rod 2 comprises an upper rod 21, a middle rod 22 and a lower rod 23 from top to bottom. The middle rod 22 and the lower rod 23 are telescopically coupled to each other. The upper end of the middle rod 22 is connected to the upper rod 21 by a one-way connector 24. The middle rod 22 and the lower rod 23, for example when retracted, can be folded upwards to lean against the upper rod 21. The top transverse rod 1 is coupled with a cantilever rod 3, and the cantilever rod 3 is connected to the middle portion of the top transverse rod 1 in a crossing manner. In an embodiment, the cantilever rod 3 is a foldable rod with three segments. The cantilever rod 3 comprises a rod piece 31 positioned in the middle and connected to the top transverse top rod. The two ends of the rod piece 31 are respectively connected to a side rod piece 32 by a one-way connector 33. The cantilever rod 3 is rotatably connected to the top transverse rod 1. The top transverse rod 1 is provided with a connecting base 12, and the middle portion of the cantilever rod 3 is provided with a connector 34 movably connected to the connecting base 12, thereby rotatably connecting the cantilever rod 3 to the top transverse rod 1. Folding and unfolding of the tent with an enhanced tent top in accordance with the fourth embodiment is the same as or similar to that in accordance with the first embodiment, details of which are omitted to avoid redundancy.

According to the present invention, the tent is improved with enhanced tent top. The cantilever rod is movably connected to the top transverse rod at the top of the tent. The cantilever rod is connected to the top transverse rod and extended to two sides of the top transverse rod, thereby supporting the tent cloth at the top of the tent in multiple directions and thus increasing the top area and the usable space of the tent. Moreover, the cantilever rod of the present invention is simple, can be rotated and folded, and thus is convenient to fold and use.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

The invention claimed is:

1. A tent with an enhanced tent top, comprising:

a top transverse rod having two ends;

a plurality of upright rods comprising four upright rods;

two tee connectors, each pivotally connected to one end of the top transverse rod and two upright rods;

a connecting base disposed at a middle portion of the top transverse rod, and comprising a positioning port formed axially in a middle portion of the connecting base, a U-shaped clip, and two openings formed radially and symmetrically in the connecting base;

a cantilever rod comprising two free ends; and a first connector disposed at a middle portion of the cantilever rod, and comprising a neck and a snap ring formed below the neck, wherein when in use:

the first connector is inserted and rotatable in the positioning port of the connecting base;

the U-shaped clip is inserted in at least one of the two openings and disposed above the snap ring on the neck of the first connector, thereby rotatably coupling the first connector with the connecting base and thus rotatably coupling the cantilever rod with the top transverse rod; and when the tent is unfolded, the two free ends of the cantilever rod extend to two sides of the top transverse rod.

2. The tent of claim 1, wherein the cantilever rod comprises:

a middle rod connected to a middle portion of the top transverse rod, the middle rod having two ends;

two side rods; and two one-way connectors, each pivotally connected to one end of the middle rod and one side rod.

3. The tent of claim 1, wherein the top transverse rod is a fiber rod.

4. The tent of claim 1, wherein the top transverse rod is telescopic.

5. The tent of claim 1, wherein the top transverse rod comprises two inner sleeves, and an outer sleeve disposed between and telescopically coupled with the two inner sleeves.

6. The tent of claim 1, wherein the cantilever rod is telescopic.

7. The tent of claim 1, wherein the upright rod comprises:

an upper rod having an upper end connected with a corresponding tee connector;

a middle rod having an upper end pivotally connected to a lower end of the upper rod through a one-way connector; and a lower rod telescopically coupled to the middle rod.

8. The tent of claim 7, wherein the upper rod is a fiber rod.

9. The tent of claim 1, wherein the upright rod comprises:

an upper rod having an upper end connected with a corresponding tee connector, the upper rod being a fiber rod; and a lower rod telescopically coupled with the upper rod.

* * * * *